US005596392A

United States Patent [19]

Danzuka

[11] Patent Number: 5,596,392

[45] Date of Patent: Jan. 21, 1997

[54] MAGNETIC SEAL PROVIDED AT AN END PORTION OF THE DEVELOPER CARRYING MEMBER

[75] Inventor: Toshimitsu Danzuka, Tokyo, Japan

[73] Assignee: Canon Kabushiki Kaisha, Tokyo, Japan

[21] Appl. No.: 408,991

[22] Filed: Mar. 23, 1995

[30] Foreign Application Priority Data

Mar. 25, 1994 [JP] Japan ..... 6-055910

[51] Int. Cl.[6] ..... G03G 15/06

[52] U.S. Cl. ..... 399/98; 399/274

[58] Field of Search ..... 355/245, 251, 355/215; 118/658

[56] References Cited

U.S. PATENT DOCUMENTS 3,982,498 9/1976 Wilcox ..... 118/658
5,177,536 1/1993 Watanabe et al. ..... 355/251
5,187,326 2/1993 Shirai ..... 355/251 X
5,267,007 11/1993 Watanabe et al. ..... 355/245
5,287,148 2/1994 Sakemi et al. ..... 355/245

*Primary Examiner*—Nestor R. Ramirez
*Attorney, Agent, or Firm*—Fitzpatrick, Cella, Harper & Scinto

[57] ABSTRACT

A developing apparatus including a developer container for accommodating a developer having magnetic particles; a rotatable developer carrying member, provided in a opening of the the developer container for carrying the developer; a magnet in the developer carrying member; a magnetic member, provided at a end portion of the developer carrying member, being subjected to magnetic force of the the magnet; wherein the magnetic member is positioned with a gap relative to the developer carrying member, along a circumference of the developer carrying member; a regulating member for regulating the developer on the the developer carrying member; wherein magnetic confining force for the developer by the magnetic member is weaker toward a regulation portion of the regulating member in a circumferential direction of the developer carrying member.

14 Claims, 6 Drawing Sheets

MAGNETIC SEAL PROVIDED AT AN END PORTION OF THE DEVELOPER CARRYING MEMBER

FIELD OF THE INVENTION AND RELATED ART

The present invention relates to a developing device for developing an electrostatic image on an image bearing member usable with an electrostatic recording process or an electrophotographic process.

In the past, sealing the end portions of the developing sleeve has been used to prevent leakage of the developer.

As a sealing method in U.S. Pat. No. 5,177,536, a member is placed opposite to the developing sleeve with a gap at the end portion thereof in the thrust direction of the developing sleeve to use magnetic confining force.

FIG. 2 shows an example of the developing device preventing the leakage of developer from the end portion by the magnetic confining force.

FIG. 2, (*a*) is a sectional front view, and FIG. 2, (*b*) is a sectional side view.

In FIG. 2, designated by 200 is a developer container with shaft 211 of a magnet roller. Shaft 210 is fixed to the developer container 200 by a fixing member 212.

Therefore, the magnet roller 210 is stationary relative to the developer container 200. In addition, designated by 220 is a developing sleeve of a non-magnetic material containing the above-described magnet roller 210. The developing sleeve is supported by bearings 221. Also, the sleeve rotates relative to the developer container 200 via the bearings 221.

The above-described magnet roller 210, as shown in FIG. 2, has 5 magnetic poles S1 pole, S2 pole, N1 pole, N2 pole, and N3 pole). The two component developer including the non-magnetic toner and magnetic carrier is taken up on the outside surface of developing sleeve 220 by the N3 pole (take-up pole). The taken up developer is transported to the S2 pole (transportation pole) in accordance with the rotation of developing sleeve 220 in the direction of a arrow R in FIG. 2. The developer thereafter is coated as the thin layer on the outside surface of the developing sleeve 220 by the of N1 pole (cutting pole) and blade 230 then regulates the thickness of the developer layer. The developer coated as the thin layer develops a latent image formed on a unshown latent image bearing member adjacent the opposing position of S1 pole (developing pole).

The non-magnetic toner is consumed by the developing action, and this lowers toner content. This developer is transported to the N2 pole (take-in pole), and thereafter is not transported toward the N3 pole from the N2 pole by the function of the repelling magnetic field constituted by N3 pole and N2 pole. The developer that exceeds the carrying limit of the N2 pole falls by gravity in the first stirring chamber 240 in developer container 200. In the first stirring chamber 240, the first screw 241 is provided, and the developer having fallen from the developing sleeve 220 and the developer remaining without being taken up by (take-up pole) N3 pole are transported in the direction of arrow S in FIG. 2 while being stirred by the rotation of the screw.

The developer transported to the end portion of the first stirring chamber 240 by the first screw 241 is transported into the second stirring chamber 250 through the opening at an end portion of partition wall 201. By an unshown toner content detection device and a toner supply device, a proper amount of the non-magnetic toner is supplied, and thereafter is transported while being stirred by the rotation of the second screw 251, and is returned to the first stirring chamber through the opening at another end portion of the partition wall 201 to be used for the repeated developing action.

In order to prevent the leakage of the circulated developer at the neighborhood of opposite end portions in the thrust direction of the developing sleeve 220, magnetic member 260 is provided. Referring to FIGS. 3 and 4, the mechanism by which magnetic member 260 prevents leakage will be described. The same reference numerals in FIG. 2 are assigned to the elements having the corresponding functions, and the detailed description thereof are omitted for the sake of simplicity.

As shown by the magnetic force line in FIG. 3, when magnetic member 260 is provided, a strong magnetic confining force is produced between magnetic member 260 and magnet roller 210 so that the developer is confined between the magnetic member 260 and developing sleeve 220 along the magnetic force line by the magnetic confining force as shown in FIG. 4. The developer does not move in accordance with the rotation, even if the developing sleeve 220 rotates. The developer is confined by the strong magnetic confining force to form a wall between the magnetic member 260 and the developing sleeve 220 so that the leakage of the developer from developer container 200 at the neighborhood of opposite end portions in the thrust direction of the developing sleeve 220 is prevented.

However, when the length in the thrust direction of the developing sleeve 220 is shortened as much as possible in an attempt to meet the recent demand for decreasing the size of the image forming apparatus the length of magnet roller 210 in the thrust direction is also shortened. This creates the following problems.

The problems will be described, referring to FIGS. 5 and 6. FIGS. 5 and 6, the same reference numerals as in FIG. 2 are assigned to elements having the corresponding functions, and the detailed description thereof is omitted for the sake of simplicity.

As shown in FIGS. 5 and 6 when the length of magnet roller 210 in the thrust direction is shortened, position of the magnetic member 260 necessarily approaches the end portion of the magnet roller 210. This is because, when the position of magnetic member 260 is changed toward the thrust direction, simultaneously the width in the thrust direction of the developer applied in the thin layer on the developing sleeve 220 decreases. Therefore the entire area of the image of the maximum width in the thrust direction which is determinated in accordance with the specifications of the image forming apparatus using the developing device, is now unable to be developed.

In addition, when the position of magnetic member 260 further approaches the end portion of magnet roller 210, as shown in FIG. 5, the magnetic force line formed between the magnet roller 210 and the magnetic member 260 becomes sparse and broad, since the magnetic flux density at the end portion of magnet roller 210 is small as compared with positions in the middle of magnet roller 210. In addition, the magnetic flux density of magnet roller 210 is larger in the thrust direction, and therefore pulls the magnetic force line inwardly in the thrust direction as shown in FIG. 5. Therefore, the configuration of the wall of the developer formed between developing sleeve 220 and magnetic member 260 becomes as shown in FIG. 6.

When the wall of the developer becomes as shown in FIG. 6 adjacent the blade, the end portion of the developer to be coated as the thin layer on the developing sleeve 220 is obstructed by the wall of the developer stretched widely in the thrust direction. Thus, the developer coating width on the developing sleeve in the thrust direction is narrowed, and the entire area of the image of the maximum width in the thrust direction is now unable to be developed.

SUMMARY OF THE INVENTION

A function of the present invention is to provide a developing device wherein a uniform thickness of the developer is provided over the developing width on the developer carrying member.

Another object of the present invention is to provide a developing device wherein the length in the thrust direction of the developer carrying member is shortened.

According to an aspect of the present invention, there is provided a developing apparatus comprising a developer container for accommodating a developer having magnetic particles; a rotatable developer carrying member provided in an opening of the said developer container for carrying the developer; a magnet in said developer carrying member; a magnetic member, provided at an end portion of said developer carrying member, being subjected to magnetic force of the said magnet; wherein said magnetic member is disposed with a gap relative to said developer carrying member along a circumference of said developer carrying member; a regulating member for regulating the developer on the said developer carrying member; wherein magnetic confining force for the developer by said magnetic member is weaker toward a regulation portion of said regulating member in a circumferential direction of said developer carrying member.

These and other objects, features, and advantages of the present invention will become more apparent upon a consideration of the following description of the preferred embodiments of the present invention taken in conjunction with the accompanying drawings.

BRIEF DESCRIPTION OF THE DRAWINGS

FIG. 1, (*b*) is a sectional side view of an apparatus of FIG. 1, (*a*).

FIG. 2, (*b*) is a sectional side view of the apparatus of FIG. 2 (*a*).

FIG. 9, (*b*) is a sectional side view of the apparatus of FIG. 9, (*a*).

DESCRIPTION OF THE PREFERRED EMBODIMENTS

The present invention of the embodiments in conjunction with the accompanying drawings will be described.

Figure 2A:
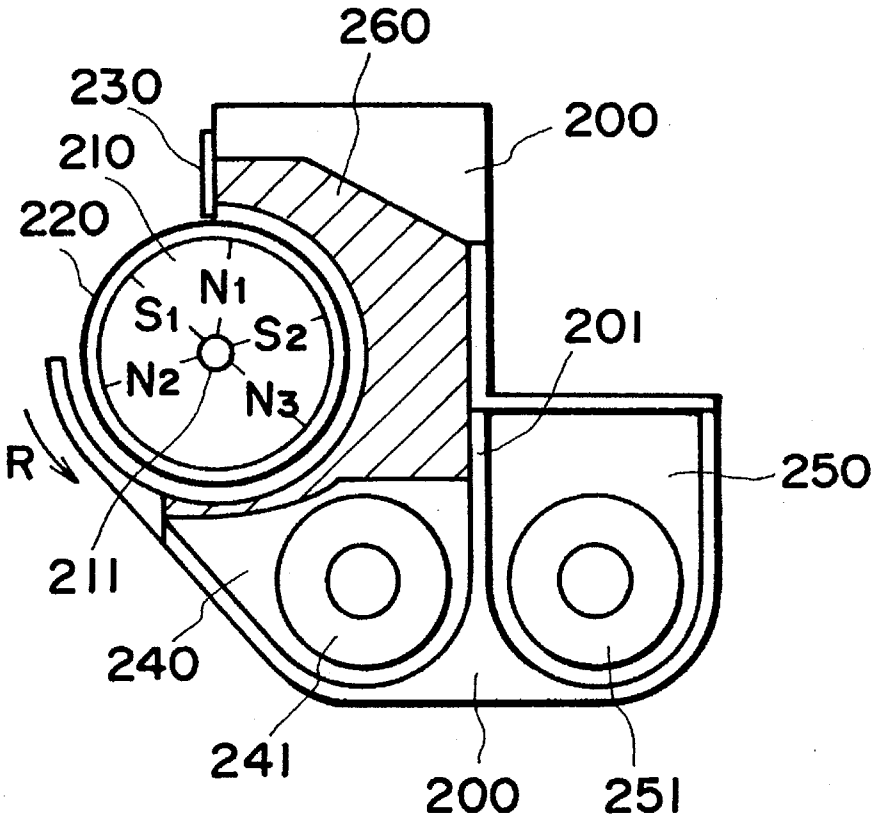
FIG. 2, (*a*) is a sectional front view of the developing device as a background of the present invention.
Figure 2B:
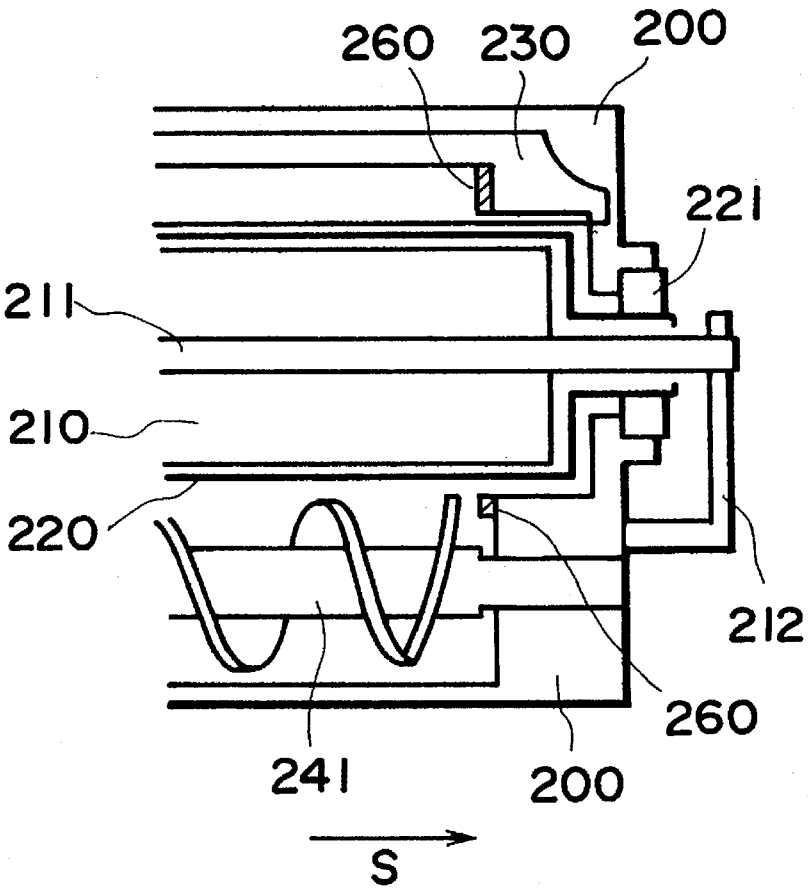
Figure 3:
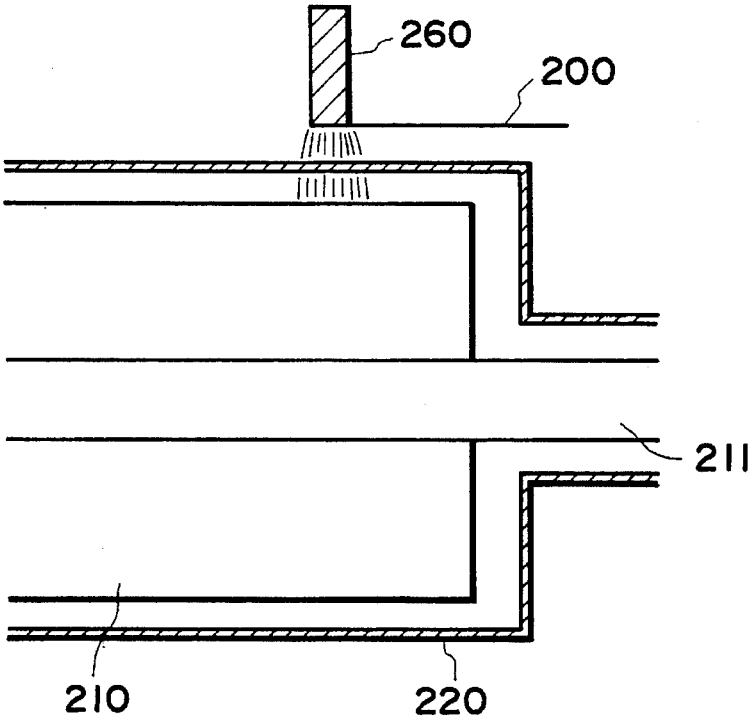
FIG. 3 and FIG. 4 illustrate the prevention of leakage of the developer.

The same reference numerals as in FIG. 2 are assigned to elements having the corresponding functions, and the detailed description thereof are omitted for the sake of simplicity.

Figure 1A:
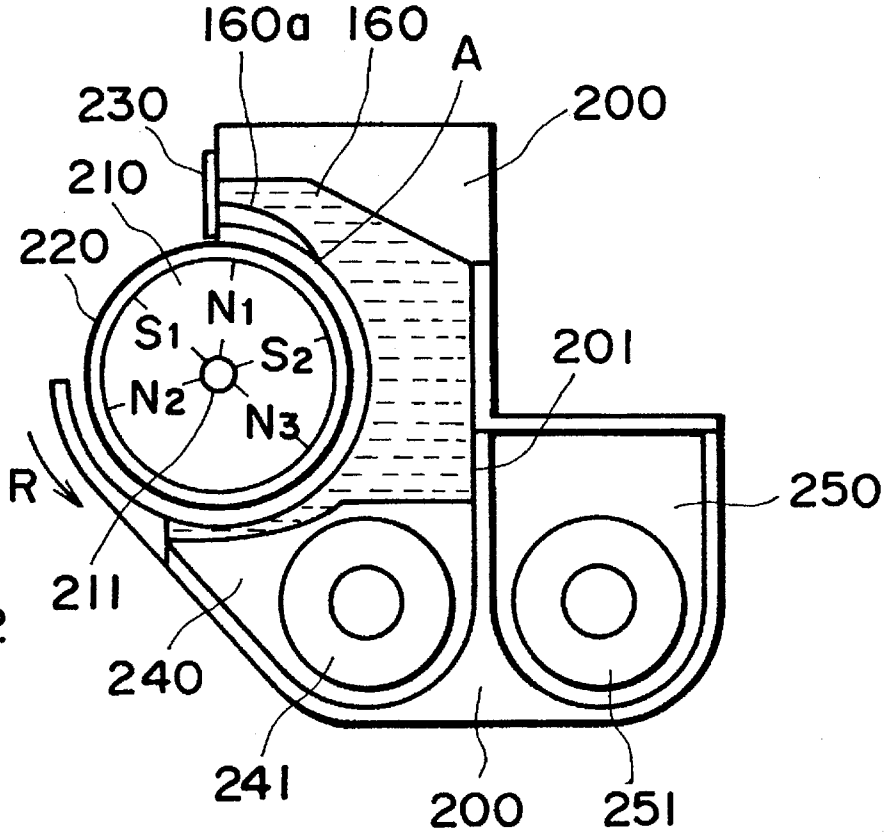
FIG. 1, (*a*) is a sectional front view of a developing device according to an embodiment of the present invention.
Figure 1B:
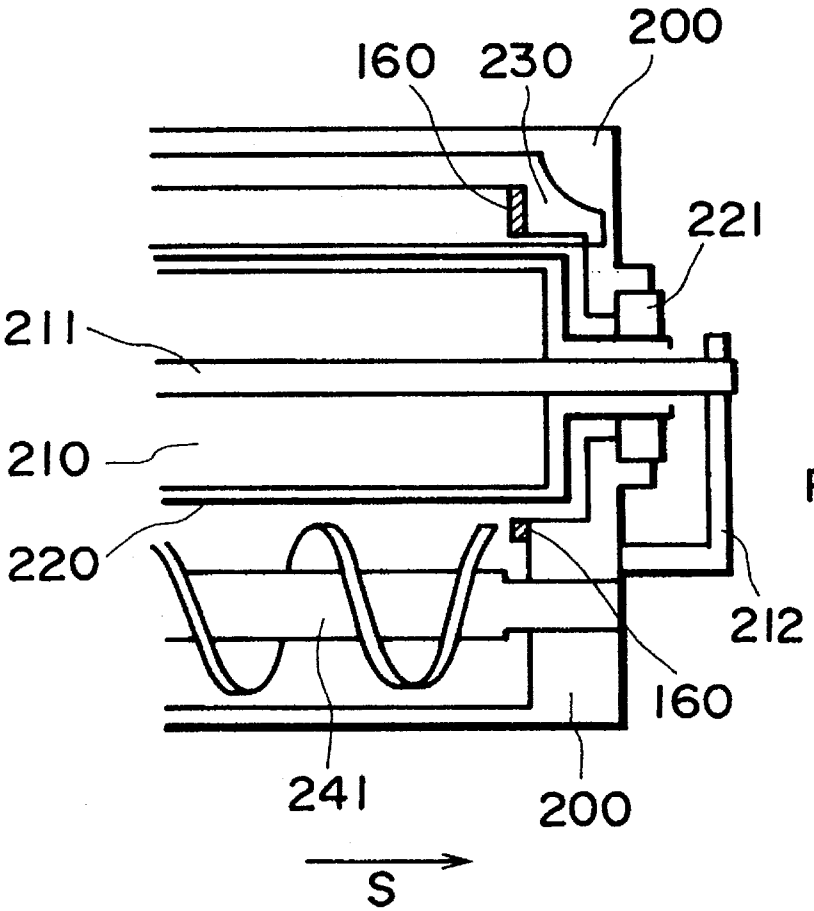

In FIG. 1, a sectional view of a developing device according to an embodiment of the present invention is shown.

The magnetic member 160 comprising a ferromagnetic member such as iron, cobalt, or nickel is placed opposite a gap from a surface of the developing sleeve at the end portion in the thrust direction of developing sleeve 220. Developing sleeve 220 comprises a non-magnetic metal such as aluminum, and SUS as a developer carrying member for carrying the developer comprising a magnetic carrier and a non-magnetic toner. Magnetic member 160 extends over approximately one-half of the circumference in the circumferential direction of developing sleeve 220.

Figure 4:
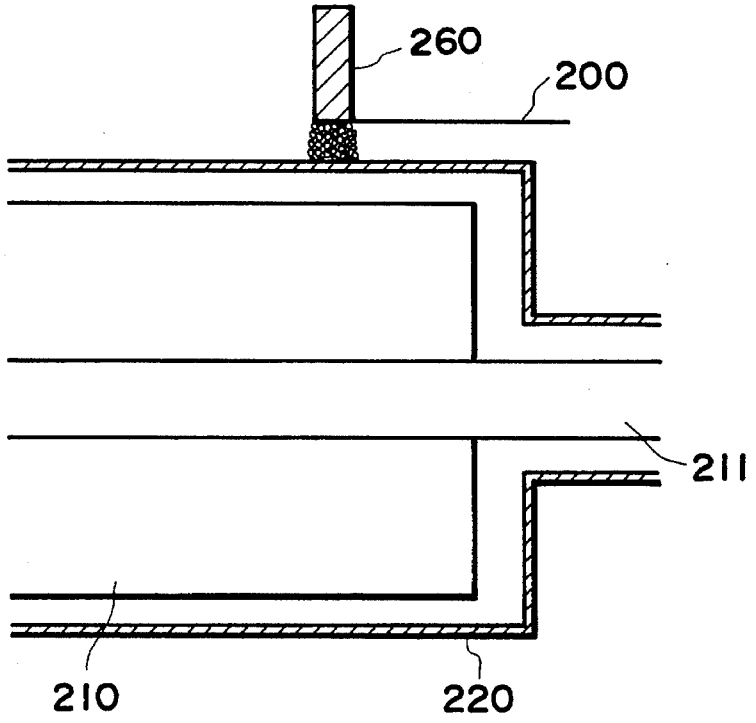
Figure 5:
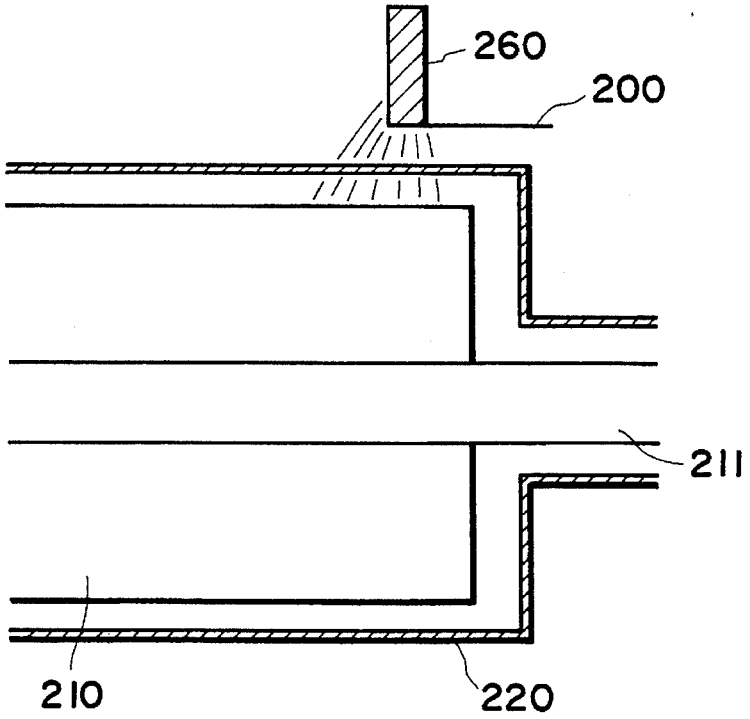
FIG. 5 and FIG. 6 illustrate the task to be solved by the present invention.
Figure 6:
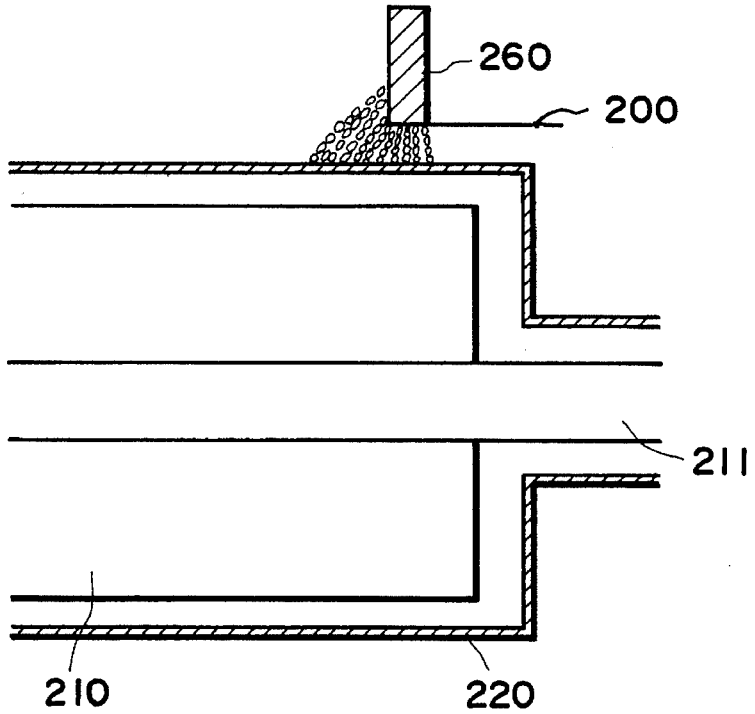

In the thrust direction, the magnetic member 160 is positioned inwardly, beyond the end surface of magnet roller 210 producing the magnetic force for carrying the developer. The magnetic force created by magnet roller 210 is concentrated, and the magnetic brush of the carrier is formed similar to FIG. 4 by the magnetic confining force so as to prevent the leakage of the developer.

In addition, in this embodiment, magnetic member 160 includes a magnetic force reduction portion 160*a* having a large gap between the adjacent surface of developing sleeve 220 in the circumferential direction of the developer carrying member. Magnetic member 160 also includes blade 230 as a developer regulation member for regulating a amount of the developer on the developer carrying member comprising a non-magnetic metal such as SUS aluminum.

Due to the demand for reducing the size of the image forming apparatus using the present developing device, the lengths of developing sleeve 220 and magnet roller 210 in the thrust direction have been shortened, and therefore, the position of magnetic member 160 is closer to the end portion of magnet roller 210.

Figure 7:
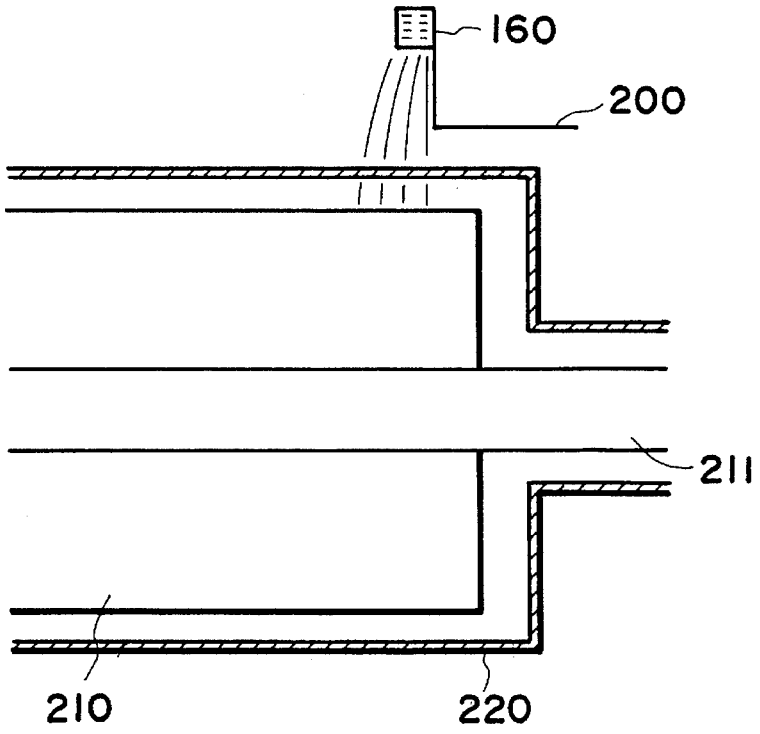
FIG. 7 and FIG. 8 illustrate the effects according to an embodiment of the present invention.
Figure 8:
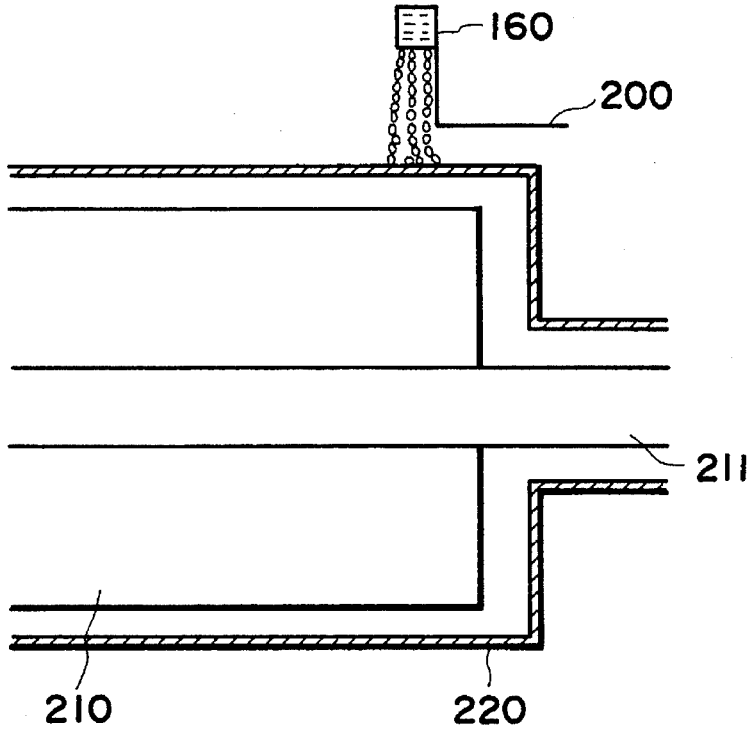

FIGS. 7 and 8 show magnetic force lines between magnetic member 160 and magnet roller 210 adjacent the blade 230, and a wall constituted by the developer between magnetic member 160 and developing sleeve 220, with this structure.

The same reference numerals used in FIG. 1 are assigned to the elements having the corresponding functions, and the detailed descriptions thereof are omitted for the sake of simplicity. As shown in FIG. 8, the width of the wall of the developer adjacent the blade is narrowed due to a decrease of the magnetic confining force, and the developer is hardly confined inside of the magnetic member 160 in the thrust direction. Therefore, the width of the developer in the thrust direction applied as the thin layer on the developing sleeve 220 can be assured, such that the entire area of the image having the maximum thrust direction width in the image forming apparatus using the present developing device can be developed.

The blocking effect of the wall of the above-described developer is wakened. However, durability tests indicate that the problem of rotation load increase for the developing sleeve 220 due to the leakage of the developer does not materialize over the lifetime of the developing device. Test conditions are as follows:.

Developing sleeve diameter: 24.5 mm

Rotational frequency of the developing sleeve: 186 rpm

Cutting pole magnetic flux density of the magnet roller at magnetic member portion: 360 G Cutting pole half-peak width of the magnet roller at magnetic member portion: 50°

Cutting pole magnetic flux density of the magnet roller other than magnetic member portion: 650 G Cutting pole half-peak width of the magnet roller other than magnetic member portion: 50°

Magnetic member/developing sleeve clearance at the blade contact portion: 6 mm

Magnetic member/developing sleeve clearance other than the neighborhood of the blade: 1.5 mm Average particle size of the magnetic carrier: 50 microns The maximum magnetization of the magnetic carrier: 60 emu/g Magnetic material: Fe (Ni plating)

Developing device lifetime: 60000 sheets (A4 size image output)

A point (A in FIG. 1) where the clearance between the magnetic material 160 and developing sleeve 220 starts to widen is positioned downstream (direction of arrow R in FIG. 1) with respect to the movement direction of the periphery of developing sleeve 220, of the point where the magnetic flux density between pole N1 and pole S2 is 0.

The magnet roller has the magnetic pole N1 in the region opposed to the magnetic force reduction portion 160*a*, and particularly, the magnetic flux density of the region opposed to the magnetic force reduction portion 160*a* of the magnet roller is not zero.

Therefore, even if the magnetic force is reduced adjacent to the magnetic material, the device can prevent developer leakage.

Embodiment 2.

Figure 9A:
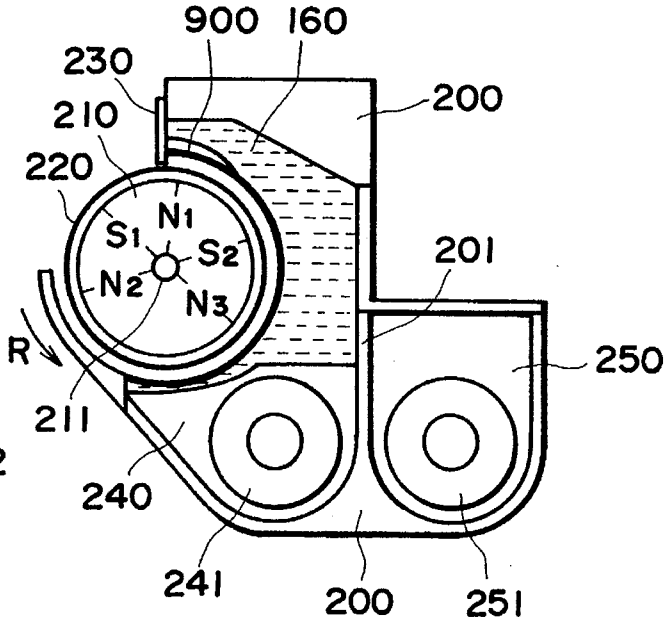
FIG. 9, (*a*) is a sectional front view of the developing device according to another embodiment of the present invention.
Figure 9B:
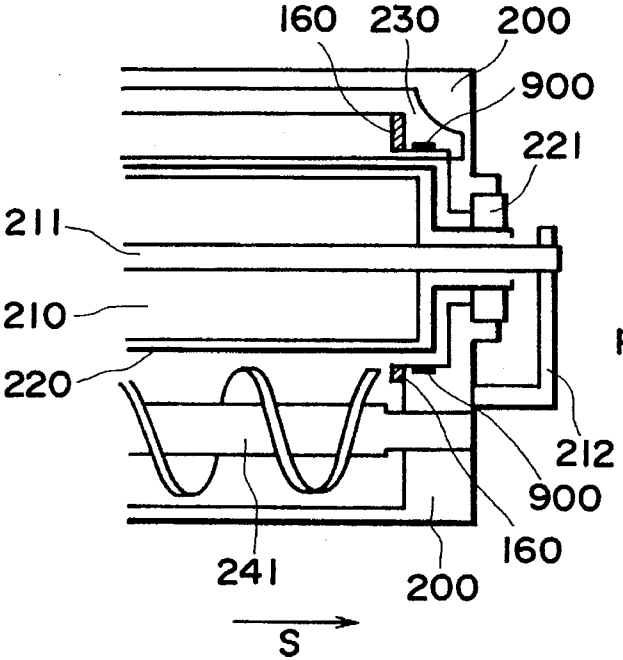

FIG. 9 schematically shows the arrangement of this embodiment. The same reference numerals as in FIG. 1 are assigned to the elements having the corresponding functions, and the detailed descriptions thereof are omitted for the sake of simplicity.

In FIG. 9, designated by 900 is a magnet provided outside the magnetic material 160 in the thrust direction. The magnet is magnetized to the S-pole at the side opposite developing sleeve 220 and the N-pole at the opposite side therefrom. The component of magnetic flux density toward the center of the magnet roller 210 is 200 G and is arcuated.

By confining the very small amount of developer that passed the wall of the developer formed by magnet roller 210 and magnetic material 160, by said magnet, the lifetime of the developing device of this embodiment can be extended to approximately 4 times the lifetime of the developing device of the first embodiment.

The durability test conditions are the same as in the first embodiment.

Embodiment 3.

In the first and the second embodiment, the present invention is applied to the developing device using a two component developer, including a non-magnetic toner and a magnetic carrier. The present invention is not limited to a developing device using a two component developer. It is effective also in the case that it is applied to a developing device using magnetic one component toner.

However, generally, the average particle size of the magnetic one component toner is smaller than the magnetic carrier, (i.e. 10 microns). Therefore, in this embodiment, the clearance between the developing sleeve and magnetic material end portion is 2 mm, adjacent the blade, and 0.5 mm in the other portion.

Figure 10:
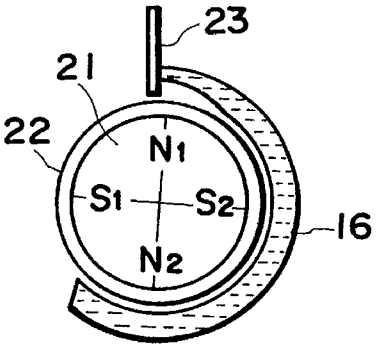
FIG. 10 is a partial sectional view of a developing device of another embodiment of the present invention.

FIG. 10 schematically shows the arrangement of the major part of this embodiment.

In this Figure, reference numeral 21 designates a magnet roller, 22 designates a developing sleeve, 23 designates a blade, 16 designates a magnetic member. The other structures are the same as in FIG. 1, and the detailed description is omitted.

As described above, according to the present invention, even if the length in the thrust direction of the magnet roller is shortened as much as possible in accordance with market demands, for downsizing of the image forming apparatus, the width of the developer wall constituted by the magnetic material provided in order to prevent the leakage of the developer toward the outside in the thrust direction can be narrowed as much as possible. Therefore, the entire width of the maximum image of the image forming apparatus in the thrust direction can be developed.

While the invention has been described with reference to the structures disclosed herein, it is not confined to the details set forth and this application and is intended to cover such modifications or changes as may come within the purposes of the improvements or the scope of the following claims.

What is claimed is:

1. A developing apparatus comprising:

a developer container for accommodating a developer having magnetic particles;

a rotatable developer carrying member, provided in an opening of said developer container, for carrying the developer;

a magnet in said developer carrying member;

a magnetic member, provided at an end portion of said developer carrying member, being subjected to magnetic force of said magnet;

wherein said magnetic member is disposed with a gap relative to said developer carrying member, along a circumference of said developer carrying member;

a regulating member for regulating the developer on said developer carrying member;

wherein magnetic confining force for the developer by said magnetic member is weaker toward a regulation portion of said regulating member in a circumferential direction of said developer carrying member.

2. An apparatus according to claim 1 wherein the magnetic confining force is substantially constant excluding a neighborhood of the regulation portion.

3. An apparatus according to claim 1, wherein the gap between said developer carrying member and said magnetic member is wider toward the regulation portion of said regulating member in a circumferential direction.

4. An apparatus according to claim 3, wherein in a region opposed to a portion having a wide gap adjacent to the regulation portion of said magnet roller, the magnetic flux density is not zero.

5. An apparatus according to claim 3, wherein said magnet roller has a magnetic pole in a region opposed to a portion having a wide gap adjacent the regulation portion.

6. An apparatus according to claim 1 wherein the gap is substantially constant excluding a neighborhood of the regulation portion.

7. An apparatus according to claim 1, wherein said magnetic member comprises iron material.

8. An apparatus according to claim 7, wherein the iron is plated with Ni.

9. An apparatus according to claim 1, wherein a brush of the magnetic particles is formed by the magnetic force of said magnet between said developer carrying member and said magnetic member, the brush being effective to prevent leakage of the developer.

10. An apparatus according claim 1, further comprising an auxiliary seal member outside said magnetic member in a thrust direction of said developer carrying member.

11. An apparatus according to claim 10, wherein said auxiliary seal member includes a magnet.

12. An apparatus according to claim 1, wherein said magnet is extended along a thrust direction of said developer carrying member, and said developer carrying member produces magnetic force for carrying the developer for development.

13. An apparatus according to claim 12, wherein said magnetic member is disposed inside an end portion of said magnet in the thrust direction of said developer carrying member.

14. An apparatus according to claim 1, wherein the developer contains non-magnetic toner.

* * * * *

UNITED STATES PATENT AND TRADEMARK OFFICE

CERTIFICATE OF CORRECTION

PATENT NO. : 5,596,392 Page 1 of 3

DATED : January 21, 1997

INVENTOR(S) : Toshimitsu DANZUKA

It is certified that error appears in the above-indentified patent and that said Letters Patent is hereby corrected as shown below:

ON THE COVER PAGE

Under item [57] "ABSTRACT":

Line 5, "the" (second occurrence) should be deleted;
Line 7, "a" should read --an--;
Line 8, "the" (second occurrence) should be deleted; and
Line 12, "the" (third occurrence) should be deleted.

COLUMN 1:

Line 40, "a" should read --an--;
Line 43, "of" should be deleted; and
Line 66, "device and a toner supply device," should read --device, and a toner supply device--.

UNITED STATES PATENT AND TRADEMARK OFFICE

CERTIFICATE OF CORRECTION

PATENT NO. : 5,596,392

DATED : January 21, 1997

INVENTOR(S) : Toshimitsu DANZUKA

It is certified that error appears in the above-indentified patent and that said Letters Patent is hereby corrected as shown below:

COLUMN 2:

Line 40, "and 6" should read --and 6,--;
Line 47, "Therefore" should read --Therefore,--; and
Line 49, "determinated" should read --determined--.

COLUMN 3:

Line 8, "A function" should read --A principal function--.

COLUMN 4:

Line 29, "a" should read --an--;
Line 58, "wakened." should read --weakened.--; and
Line 62, "follows:." should read --follows:--.

UNITED STATES PATENT AND TRADEMARK OFFICE

CERTIFICATE OF CORRECTION

PATENT NO. : 5,596,392 Page 3 of 3

DATED : January 21, 1997

INVENTOR(S) : Toshimitsu DANZUKA

It is certified that error appears in the above-indentified patent and that said Letters Patent is hereby corrected as shown below:

COLUMN 5:

Line 54, "two" should read --two- --;
Line 57, two component" should read --two-component--;
Line 59, "one component" should read --one-component--; and
Line 61, "one component" should read --one-component--.

COLUMN 6:

Line 17, "and" (second occurrence) should be deleted;
Line 42, "claim 1" should read --claim 1,--;

Line 56, "claim 1" should read --claim 1,--.

Signed and Sealed this

Fifteenth Day of July, 1997

Bruce Lehman

*Attest:*

BRUCE LEHMAN

*Attesting Officer*

*Commissioner of Patents and Trademarks*